US007408480B2

(12) United States Patent
Woo et al.

(10) Patent No.: US 7,408,480 B2
(45) Date of Patent: Aug. 5, 2008

(54) DUAL MODE ELECTRONIC TOLL COLLECTION TRANSPONDER

(75) Inventors: Henry Sun Yee Woo, Markham (CA); Wai-Cheung Tang, Mannheim (CA); Paul Anthony Laing Manuel, North York (CA); Weimin He, Richmond Hill (CA); Daniel Terrier, Toronto (CA); Roger Tong, Oakville (CA)

(73) Assignee: Mark IV Industries Corp., Mississauga, Ontario (CA)

( * ) Notice: Subject to any disclaimer, the term of this patent is extended or adjusted under 35 U.S.C. 154(b) by 281 days.

(21) Appl. No.: 11/409,897

(22) Filed: Apr. 24, 2006

(65) Prior Publication Data

US 2006/0255968 A1 Nov. 16, 2006

Related U.S. Application Data

(60) Provisional application No. 60/673,764, filed on Apr. 22, 2005.

(51) Int. Cl.
*G08G 1/00* (2006.01)

(52) U.S. Cl. ..... 340/928; 340/572.1; 340/572.4

(58) Field of Classification Search ..... 340/572.1, 340/572.4, 572.7, 539.1, 539.11, 539.23, 340/928, 933, 438; 705/13, 22; 342/12; 375/282, 361

See application file for complete search history.

(56) References Cited

U.S. PATENT DOCUMENTS 4,104,630 A 8/1978 Chasek
4,303,904 A 12/1981 Chasek
4,870,419 A 9/1989 Baldwin et al.
4,937,581 A 6/1990 Baldwin et al.
5,086,389 A 2/1992 Hassett et al.

(Continued)

FOREIGN PATENT DOCUMENTS

EP 0 333 679 9/1989

(Continued)

OTHER PUBLICATIONS

Tang et al., Method of Enabling Two-State Operation of Electronic Toll Collection Systems, U.S. Appl. No. 11/437,236, filed May 19, 2006.

(Continued)

*Primary Examiner*—Van T. Trieu
(74) *Attorney, Agent, or Firm*—Hanley, Flight & Zimmerman, LLC

(57) ABSTRACT

A dual mode transponder for engaging in RF communications with a roadside reader from a vehicle. The transponder includes an antenna, an electronic toll collection (ETC) component, and an external interface. The ETC component implements a pre-defined ETC communications protocol to detect and interpret received signals and generate response signals when operating in an ETC mode. The ETC component also includes a bypass port. The external interface is coupled to the bypass port and has an external port for receiving input signals. The ETC component includes a bypass module for receiving a bypass instruction and entering a bypass mode. In the bypass mode the ETC component refrains from implementing the ETC communications protocol. Instead, the ETC component transmits the input signals relayed from the external interface to the ETC component to the reader.

24 Claims, 10 Drawing Sheets

U.S. PATENT DOCUMENTS

| | | | | |
|---|---|---|---|---|
| 5,132,687 | A | 7/1992 | Baldwin et al. | |
| 5,144,553 | A | 9/1992 | Hassett et al. | |
| 5,164,732 | A | 11/1992 | Brockelsby et al. | |
| 5,196,846 | A | 3/1993 | Brockelsby et al. | |
| 5,253,162 | A | 10/1993 | Hassett et al. | |
| 5,266,947 | A | 11/1993 | Fujiwara et al. | |
| 5,289,183 | A | 2/1994 | Hassett et al. | |
| 5,310,999 | A | 5/1994 | Claus et al. | |
| 5,351,187 | A | 9/1994 | Hassett | |
| 5,424,727 | A | 6/1995 | Shieh | |
| 5,425,032 | A | 6/1995 | Shloss et al. | |
| 5,485,520 | A | 1/1996 | Chaum et al. | |
| 5,602,375 | A | 2/1997 | Sunahara et al. | |
| 5,640,156 | A | 6/1997 | Okuda et al. | |
| 5,657,008 | A | 8/1997 | Bantli | |
| 5,675,342 | A | 10/1997 | Sharpe | |
| 5,686,920 | A * | 11/1997 | Hurta et al. | 342/42 |
| 5,701,127 | A | 12/1997 | Sharpe | |
| 5,748,106 | A | 5/1998 | Schoenian et al. | |
| 5,751,973 | A | 5/1998 | Hassett | |
| 5,771,021 | A | 6/1998 | Veghte et al. | |
| 5,777,565 | A | 7/1998 | Hayashi et al. | |
| 5,805,082 | A | 9/1998 | Hassett | |
| 5,819,234 | A | 10/1998 | Slavin et al. | |
| 5,831,547 | A | 11/1998 | Ohtsuki et al. | |
| 5,841,866 | A | 11/1998 | Bruwer et al. | |
| 5,850,191 | A | 12/1998 | Yagi et al. | |
| 5,857,152 | A | 1/1999 | Everett | |
| 5,859,415 | A | 1/1999 | Blomqvist et al. | |
| 5,940,006 | A | 8/1999 | MacLellan et al. | |
| 5,963,149 | A | 10/1999 | Nagura et al. | |
| 6,025,799 | A | 2/2000 | Ho et al. | |
| 6,085,805 | A | 7/2000 | Bates | |
| 6,121,880 | A | 9/2000 | Scott et al. | |
| 6,191,705 | B1 | 2/2001 | Oomen et al. | |
| 6,219,613 | B1 | 4/2001 | Terrier et al. | |
| 6,616,034 | B2 | 9/2003 | Wu et al. | |
| 6,661,352 | B2 | 12/2003 | Tiernay et al. | |
| 6,725,014 | B1 | 4/2004 | Voegele | |
| 6,725,202 | B1 * | 4/2004 | Hurta et al. | 705/13 |
| 6,885,716 | B1 * | 4/2005 | Zalud et al. | 375/361 |
| 6,898,753 | B2 | 5/2005 | Bonifas | |
| 7,091,880 | B2 * | 8/2006 | Sorensen | 340/928 |
| 2001/0050922 | A1 | 12/2001 | Tiernay et al. | |
| 2005/0234778 | A1 * | 10/2005 | Sperduti et al. | 705/22 |
| 2006/0071816 | A1 | 4/2006 | Tang et al. | |
| 2006/0082470 | A1 | 4/2006 | Zhu et al. | |

FOREIGN PATENT DOCUMENTS

| | | |
|---|---|---|
| JP | 10-105753 | 4/1998 |
| WO | WO 99/33027 | 1/1999 |

OTHER PUBLICATIONS

Woo et al., Open Road Vehicle Emissions Inspection, U.S. Appl. No. 11/409,741, filed Apr. 24, 2006.

Ho et al., Compact Microstrip Transponder Antenna, U.S. Appl. No. 11/388,737, filed Mar. 24, 2006.

Tang et al., Method and System for Obtaining Traffic Information Using Transponders, U.S. Appl. No. 11/284,277, filed Nov. 21, 2005.

Ho et al., Dynamic Timing Adjustment in an Electronic Toll Collection System, U.S. App. No. 11/176,758, filed Jul. 7, 2005.

Tang, RF Transponder with Electromechanical Power, U.S. Appl. No. 11/054,520, filed Feb. 9, 2005.

Zhu, U.S. Phase Modulation for Backscatter Transponders, U.S. Appl. No. 11/098,257, filed Apr. 4, 2005.

Zhu, U.S. System and Method for Secure Mobile Commerce, U.S. Appl. No. 10/912,997, filed Aug. 6, 2004.

U.S. Appl. No. 11/176,758, Wu, Unpublished.

U.S. Appl. No. 11/409,741, filed Apr. 24, 2006, Woo et al.

U.S. Appl. No. 11/437,236, filed May 19, 2006, Tang et al.

U.S. Appl. No. 11/388,737, filed Mar. 24, 2006, Ho et al.

U.S. Appl. No. 11/284,277, filed Nov. 21, 2005, Tang et al.

U.S. Appl. No. 11/176,758, filed Jul. 7, 2005, Ho et al.

U.S. Appl. No. 11/054,520, filed Feb. 9, 2005, Tang.

U.S. Appl. No. 11/098,257, filed Apr. 4, 2005, Zhu.

U.S. Appl. No. 10/912,997, filed Aug. 6, 2004, Zhu.

Ching et al., *A Laser Micromachined Multi-Modal Resonating Power Transducer for Wireless Sensing Systems*, Sensors and Actuators A 97-98 (2002) 685-690, http://www.elsevier.com.

Finkenzeller, Klaus, *Ch. 3: Fundamental Operating Principles, RFID Handbook: Fundamentals and Applications in Contactless Smart Cards and Identification*, Klaus Finkenzellar, (2003) John Wiley & Sons, Ltd. ISBN 0-470-84402-7.

Sorrells, *Passive RFID Basics*, AN680, Michrochip Technology Inc., (1998) DS00680B.

* cited by examiner

DUAL MODE ELECTRONIC TOLL COLLECTION TRANSPONDER

CROSS-REFERENCE TO RELATED APPLICATIONS

The present application claims priority to US provisional application Ser. No. 60/673,764 filed Apr. 22, 2005, owned in common herewith, the contents of which are incorporated herein.

FIELD OF THE INVENTION

The present invention relates to electronic toll collection transponders and, in particular, to a transponder having dual operating modes.

BACKGROUND OF THE INVENTION

Electronic toll collection systems conduct toll transactions electronically using RF communications between a vehicle-mounted transponder (a "tag") and a stationary toll plaza transceiver (a "reader"). An example of an electronic toll collection system is described in U.S. Pat. No. 6,661,352 issued Dec. 9, 2003 to Tiernay et al., and owned in common with the present application. The contents of U.S. Pat. No. 6,661,352 are hereby incorporated by reference.

In a typical electronic toll collection (ETC) system, the reader broadcasts a polling or trigger RF signal. A transponder on a vehicle passing through the broadcast area or zone detects the polling or trigger signal and responds with its own RF signal. The transponder responds by sending a response signal containing information stored in memory in the transponder, such as the transponder ID number. The reader receives the response signal and may conduct an electronic toll transaction, such as by debiting a user account associated with the transponder ID number. The reader may then broadcast a programming RF signal to the transponder. The programming signal provides the transponder with updated information for storage in its memory. It may, for example, provide the transponder with a new account balance.

There are a number of pre-defined communication protocols for reader-transponder communications in an ETC system. They include various public TDMA protocols, the State of California Code of Regulation (CALTRANS) Title 21 (T21) protocol, and proprietary protocols. An example of the latter may be seen in U.S. Pat. No. 5,196,846 to Brockelsby et al. Various pre-defined protocols are discussed in US Pub. No. US2001/0050922, published Dec. 13, 2001 and owned in common with the present application.

There are a number of other situations in which it would be advantageous to communicate wirelessly between a vehicle and a roadside reader, aside from ETC transactions.

SUMMARY OF THE INVENTION

In one aspect, the present invention provides a transponder for engaging in RF communications with a roadside reader from a vehicle. The transponder includes an antenna, an electronic toll collection (ETC) component, and an external interface. The ETC component includes an RF transceiver coupled to the antenna for modulating outgoing signals and for demodulating received signals, and a controller for implementing a pre-defined ETC communications protocol to detect and interpret the received signals and generate response signals for transmission as the outgoing signals when operating in an ETC mode. The ETC component includes a bypass port. The external interface is coupled to the bypass port and has an external port for receiving input signals. The controller includes a bypass module for receiving a bypass instruction and entering a bypass mode. In the bypass mode the input signals are relayed from the external interface to the RF transceiver for transmission as the outgoing signals.

In another aspect, the present invention provides a transponder for engaging in RF communications with a roadside reader from a vehicle. The transponder includes means for propagating an outgoing signal and receiving an incoming signal, means for modulating an information signal to generate the outgoing signal and demodulating the incoming signal to generate a received signal, and means for controlling the means for modulating to implement a pre-defined ETC communications protocol by receiving the received signal and generating the information signal when operating in an ETC mode. The transponder further includes means for interfacing with an external device to receive external signals and input the external signal to the means for controlling. The means for controlling includes means for bypassing the pre-defined ETC communications protocol by receiving a bypass instruction and entering a bypass mode, wherein in the bypass mode the external signals are relayed from the means for interfacing to the means for modulating and are transmitted as the outgoing signal.

In yet another aspect, the present invention provides a method for engaging in RF communications between a dual purpose vehicle-mounted transponder and a roadside reader. The transponder has an ETC controller for implementing a predefined ETC communications protocol. The method includes the steps of receiving an incoming signal from the roadside reader, demodulating the incoming signal to generate a received signal, and determining whether the received signal relates to an ETC transaction or a non-ETC application. The method then includes steps of generating a response signal in accordance with a pre-defined ETC communications protocol by the ETC controller and transmitting the response signal to the roadside reader, if the received signal relates to the ETC transaction. The method includes steps of receiving input data from an external device and transmitting the input data to the roadside reader, if the received signal relates to the non-ETC application.

In one aspect, the vehicle data may include emissions control data. In another aspect, the transponder includes a data buffer for accumulating data from the data bus of the vehicle information system. In another aspect, the invention includes a central server and database coupled to a plurality of roadside emission control systems through a wide area network.

Aspects of the present invention include obtaining vehicle information from a vehicle information system wirelessly in an open-road environment, and a system for performing both ETC functions and vehicle information extraction in an open road environment.

In one aspect, the reader used to scan a vehicle-mounted transponder may be a portable reader.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

References herein to "components" or "modules" or other such terms are intended to refer to all possible software constructs that may be used to implement the functions described, including subroutines, objects, modules, applications, and combinations thereof. In some cases, the components or modules may be implemented by way of a hardware component, such as a processor, ASIC, or microcontroller, operating under the control of program instructions, which may be stored in memory. The suitable programming of such devices to perform the functions and operations described herein will be within the knowledge of those of ordinary skill in the art.

Figure 9:
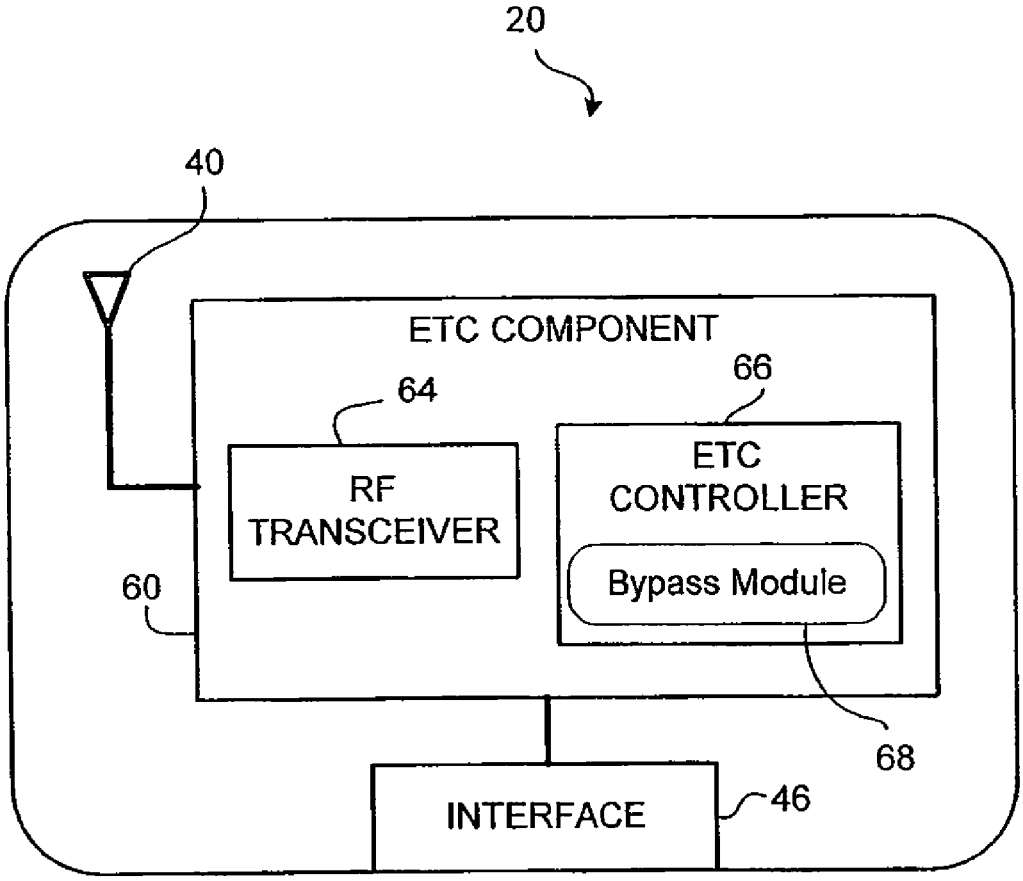
FIG. 9, shows a block diagram of an embodiment of a dual mode transponder.

Reference is first made to FIG. 9, which shows an example embodiment of a transponder 20. The transponder 20 includes an RF antenna 40, an electronic toll collection (ETC) component 60, and an interface 62.

The ETC component 60 includes an RF transceiver 64 and an ETC controller 66. In some embodiments, the ETC component 60 may be an application specific integrated circuit designed to support ETC operations, or alternatively, a gate array or equivalent programmable logic device. In other embodiments, portions of the ETC component 60 may be implemented as discrete components. In these embodiments, the ETC controller 66 may be implemented by way of a microprocessor or microcontroller, suitably programmed to carry out the ETC functions and other operations described herein.

The ETC component 60 is configured to receive RF trigger or polling signals from roadside readers via the antenna 40 in known manner. The ETC component 60 is also configured to generate a response signal in known manner. In some embodiments, the ETC component 60 generates a response signal containing transponder information, such as the transponder identification number, identity of last roadway entry point and/or time, etc. Those skilled in the art will be familiar with the known ETC communications protocols, whether public or proprietary. The present invention is not intended to be limited to known ETC protocols, but may also include new ETC protocols that may be developed.

The operation of the ETC component 60 to conduct ETC transactions and communications with a roadside reader in the known manner may be referred to as operation in an ETC mode. The ETC mode may be the default mode of operation by the ETC component 60.

The ETC component 60 is configured to receive an instruction to switch to a bypass mode. In particular, in the present embodiment, the ETC controller 66 includes a bypass module 68. The bypass module 68 detects the instruction to switch to the bypass mode.

In the bypass mode, the ETC controller 66 ceases to apply the pre-determined ETC communications protocol to generate response signals for transmission by the RF transceiver 64. Instead, the ETC component 60 makes the RF transceiver 64 available to other processes or devices that wish to engage in RF communications with the roadside reader.

The interface 62 may include one or more ports for connecting a peripheral device or system to the transponder 20 so as to use the RF transceiver 64. In bypass mode, signals received by the antenna 40 and demodulated by the RF transceiver 64 are routed to the interface 62. Signals input to the interface 64 from the peripheral device or system are sent to the RF transceiver 64 where they are modulated and transmitted as outgoing RF signals via the antenna 40. Accordingly, the transponder 20 is capable of functioning as a short-range radio link for a peripheral device.

The instruction to enter bypass mode, or to return to ETC mode, may in one embodiment, be contained within the RF trigger or polling signal sent by the roadside reader. For example, the trigger or polling signal may include a predefined bit or bit sequence to indicate a request that the transponder 20 enter bypass mode. To detect the bypass instruction, the ETC controller 66 may parse the received bit sequence, apply a bitwise mask, or use any other appropriate method or mechanism for assessing whether a predefined bit sequence or code is in the received signal.

Thereafter, communications from the reader are sent to the interface 62 and communications input to the interface 62 are transmitted to the reader. In some embodiments, the RF transceiver 64 and/or the ETC controller 66 may maintain some control over the formatting, timing, and other aspects of the RF communications link, with the peripheral device providing only payload data.

In another embodiment, the instruction to enter bypass mode may be received by the ETC component 60 through the interface. In this regard, the user of the vehicle may initiate the request to use the RF transceiver 64 for the purposes of the external peripheral device.

The interface 62 may be configured in a number of ways. In one embodiment, the interface 62 includes a standard data communications port, such as an RS-232 port, or other such ports. In another embodiment, the interface 62 may include a wireless interface, such as a Bluetooth™ module, and infrared interface or other short-range wireless interfaces.

There are a variety of applications for which a peripheral device may desire access to the RF transceiver 64 so as to send data wirelessly to a roadside reader. For example, in some instances the peripheral device may include a personal digital assistant (PDA) or other such handheld device, the dashboard graphical user interface of the vehicle, or a personal computer.

Figure 10:
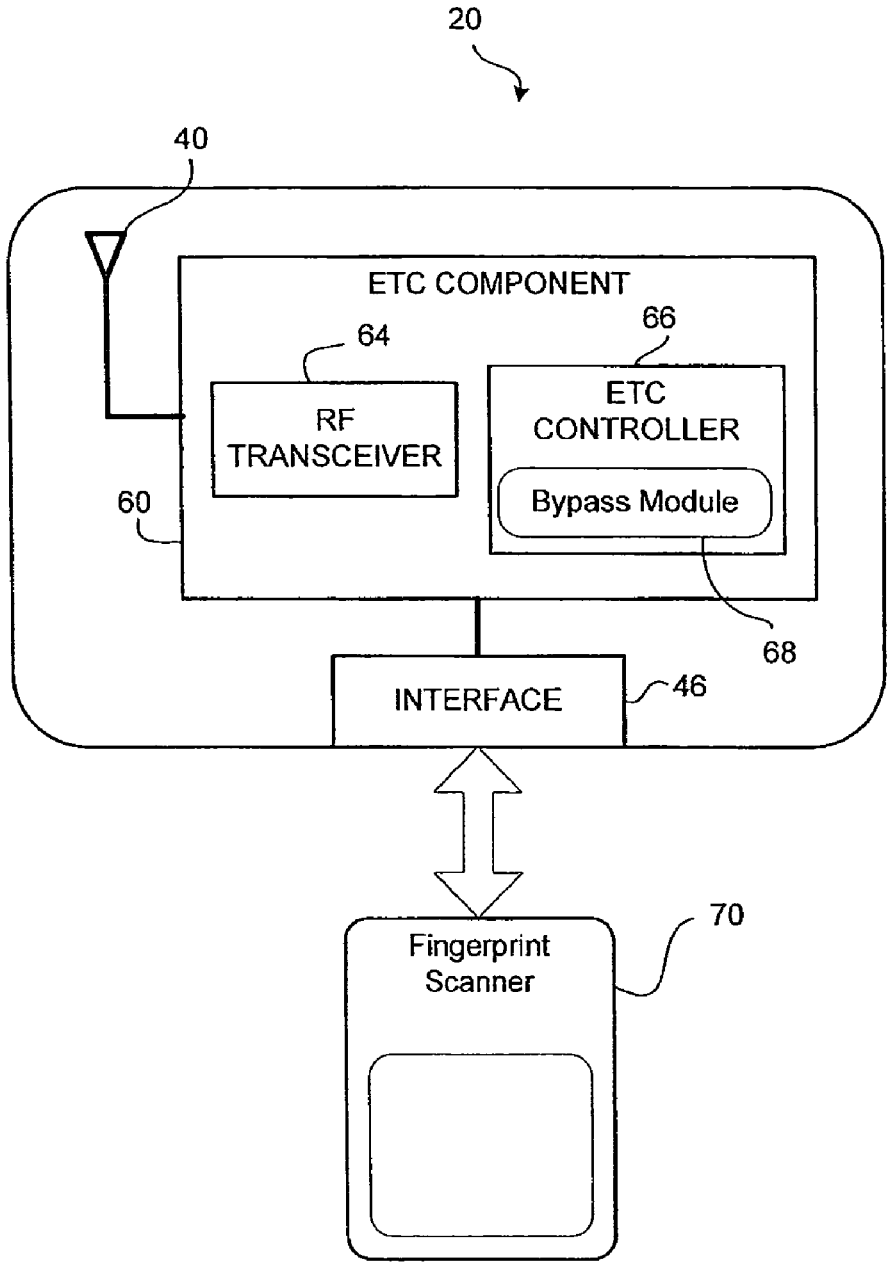
FIG. 10 shows a block diagram of the dual mode transponder of FIG. 9 in use with a biometric identification device.

In one embodiment, as shown in FIG. 10, the peripheral device comprises a biometric identification device. The biometric identification device may, in one embodiment, comprise a fingerprint scanner 70. In other embodiments, the biometric identification device may include a retinal scanner or other biometric input system for measuring biometric characteristics of an individual and converting the input to biometric data. The use of a biometric identification device may facilitate customs operations. For example, at border crossings, expedited identification and clearance may be facilitated through transmitting biometric identification data, such as fingerprint data, to a local roadside reader. The fingerprint data may be used in flagging vehicles for further inspection, waiving vehicle through, or making other decisions on border entry.

In yet another application, the biometric device may include a breath analysis device or breathalyzer. In some instances, a driver convicted of driving offences involving alcohol may be required to equip his or her vehicle with a breathalyzer device to allow the vehicle to run. In some instance, the breathalyzer data may be transmitted via the transponder 20 to a central office or law enforcement system for tracking and/or enforcement.

The ETC controller 66 may perform compression, filtering, and/or encryption operations upon any data provided by the peripheral device so as to maintain security and confidentiality and so as to reduce or packetize the data payload to a size compatible with the communications protocol.

In yet another embodiment, the peripheral device may comprise a vehicle information system.

All modern motor vehicles are equipped with on-board computer systems. These vehicle computer systems typically involve one or more computer controllers interconnected with a number of components, systems, and sensors. A data bus is often used to interconnect the various components and computers to facilitate the exchange of information. Such systems also typically provide an access port for obtaining data from the bus, and in some cases placing data on the bus, such as requests for information or instructions to particular components.

Since at least 1996, the United States has required that vehicle manufacturers incorporate on-board emissions diagnostics within the vehicle information systems. The standard relevant to light duty automobiles and trucks is referred to as on-board diagnostics (OBD). The standard currently in effect is version OBD-II, with version OBD-III in development.

A similar standard applicable to heavy vehicles is the J1708 bus and/or J1939 bus ("J-bus").

The vehicle information system is used by service personnel or an emissions inspector to obtain data regarding the vehicle; for example, a mechanic may diagnose problems with the vehicle. Certain trouble codes may trigger a dashboard alert that indicates the user should have the vehicle serviced. A service technician may plug a host computer into the access port (e.g. the OBD port) and obtain information from the vehicle information system to diagnose particular problems.

The OBD port may also be used to conduct emissions tests. A vehicle owner attends an emissions test center and a technician plugs a scan tool into the OBD port of a vehicle. Based upon the information obtained, the vehicle may be certified as emissions compliant. The OBD-based emissions testing can replace the traditional tailpipe test.

Figure 3:
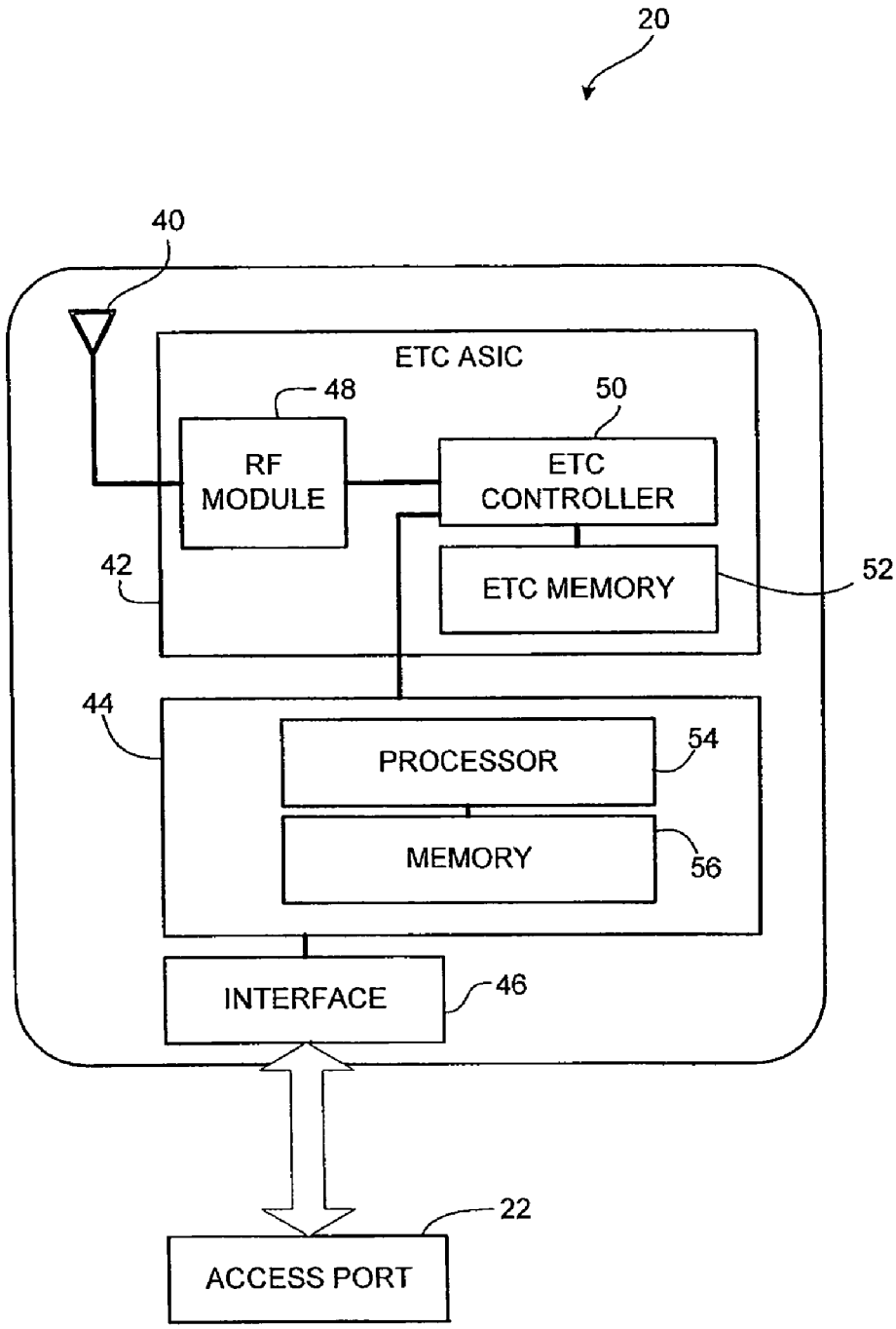
FIG. 3 shows, in block diagram form, one embodiment of a transponder.

Reference is now made to FIG. 3, which shows, in block diagram form, another embodiment of the transponder 20. The transponder 20 includes the antenna 40, an ETC application-specific integrated circuit (ASIC) 42 and a programmable microcontroller 44. The ASIC 42 includes an RF module 48 for receiving and demodulating RF signals from the antenna 40 and for modulating and transmitting RF signals to the antenna 40. The RF module 48 receives instructions from and provides demodulated signals to an ETC controller 50. The ETC controller 50 is connected to ETC memory 52. The ETC memory 52 may include permanent memory containing stored program control, and may include temporary memory containing transponder information. The transponder information comprises information used to conduct the ETC transactions, and may include such data as last access time, last reader ID, vehicle class, etc. The ETC ASIC 42 is designed for implementing the ETC transaction protocol.

Connected to the ETC ASIC 42 is the microcontroller 44. The microcontroller 44 includes a processor 54 and a memory 56. The processor 54 operates under stored program control to implement the functions and operations described herein. The microcontroller 44 is connected to a port of the ASIC 42 so as monitor communications from a roadside reader. Specifically, the microcontroller 44 detects whether the communications from the reader are indicative of ETC-related communications or vehicle information related communications. The reader transmissions may include a code or other indicator signaling whether the transmission relates to an ETC transaction or to vehicle information. The microcontroller 44 may detect a non-ETC communication by testing a received communication to determine if it contains a predetermined bit sequence or code, for example pre-defined header information indicative of the ETC protocol or a vehicle information request.

If the microcontroller 44 determines that the reader transmission relates to vehicle information instead of ETC, then it instructs the ETC ASIC 42 to enter a vehicle information mode or bypass mode, wherein the RF module 48 continues to operate normally, but the ETC controller 50 steps aside and control over the operation of the transponder 20 is passed to the microcontroller 44. In other words, the microcontroller 44 monitors the reader communications and, if it detects that the reader communications related to vehicle information instead of ETC, then the microcontroller 44 generates and sends the bypass instruction to the ETC controller 50 to tell it to enter the bypass mode.

The microcontroller 44 then conducts its communications with the reader through the RF module 48 in accordance with a predefined vehicle information communication protocol. The protocol may include receiving requests from the reader for information from a vehicle data bus, forwarding such requests (formatted as necessary) to the data bus 18 via a vehicle information system access port, receiving/reading information from the data bus via the access port, and sending the received/read information to the reader. The access port is coupled to the microcontroller 44 through an interface 46. In some embodiments, the protocol may also include storing or buffering information from the data bus in the memory 56 prior to transmission to the reader, as described further below.

It will be appreciated that the various modules and components of the transponder 20 may be implemented using discrete components or may be further integrated. The microcontroller 44 may be incorporated within another ASIC. A single ASIC may be provided to implement both the ETC and vehicle information modes of operation. Alternatively, one or more microcontrollers may be provided to implement the ETC mode of operation. Various other alternatives will be apparent to those of ordinary skill in the art.

The suitable programming of the microcontroller to implement the described functions and operations will also be within the skill of one of ordinary skill in the art, having regard to the description herein.

Figure 4:
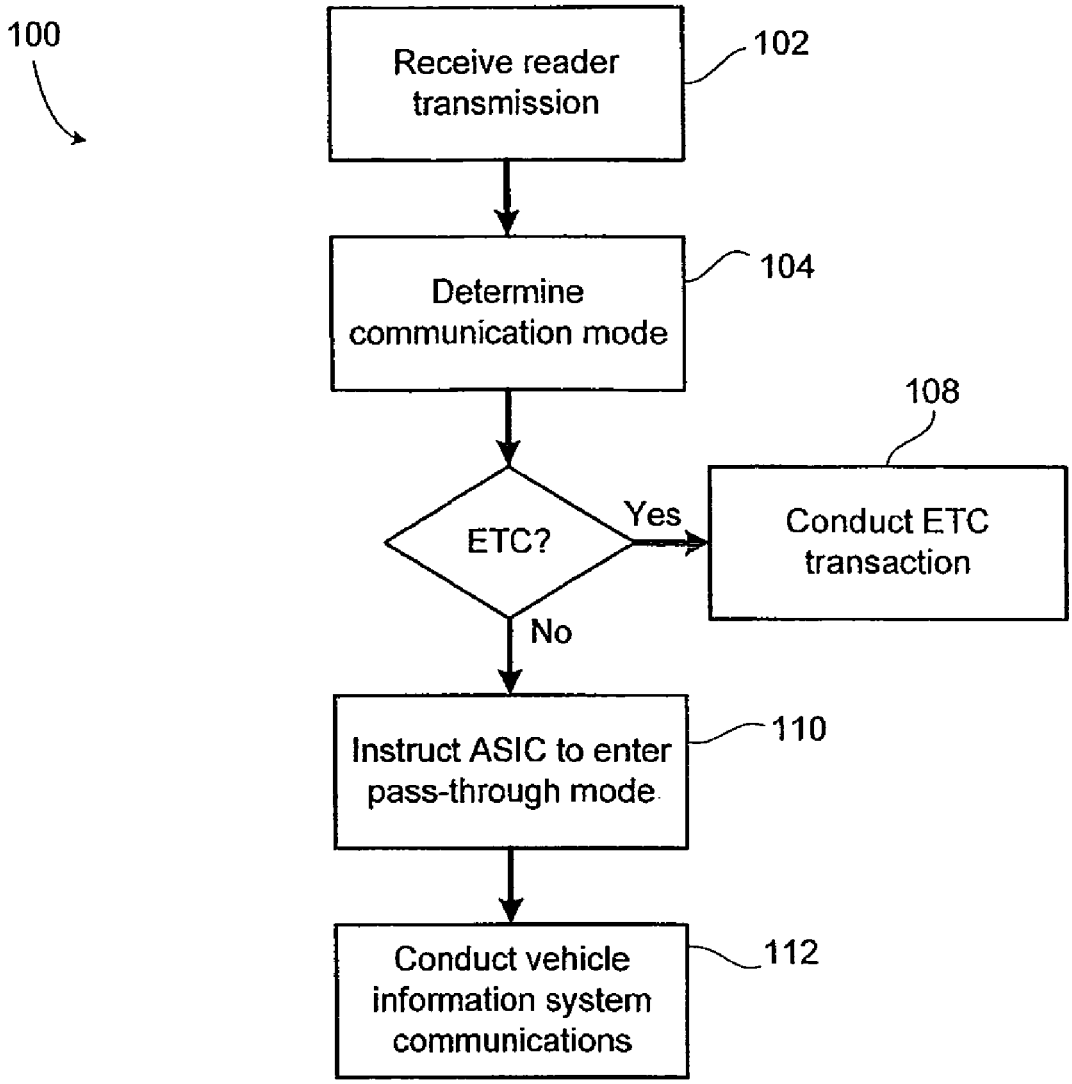
FIG. 4 shows, in flowchart form, a method of integrating ETC and a vehicle information system.

Reference is now made to FIG. 4, which shows, in flowchart form, a method of integrating ETC and a vehicle information system. It will be appreciated that the following method 100 relates to a transponder having an ETC-specific module or ASIC operating in a default ETC mode, but capable of entering a pass-through or bypass mode on instruction.

The method 100 begins in step 102 with the receipt by a vehicle-mounted transponder of a reader RF transmission. The reader RF transmission may, for example, be an interrogation signal. The reader RF transmission may alternatively be a subsequent communication sent after the exchange of interrogation and response signals by the reader and transponder to establish communications.

In step 104, the transponder determines whether the received transmission relates to an ETC transaction or to a vehicle information request. The transmission may contain an indicator, such as a numeric code, or may have a distinctive format that enables the transponder to determine whether it relates to ETC or not. If the transmission is ETC-related, then the method 100 continues in step 108. If it is not ETC-related, then the method 100 proceeds to step 110. In step 108, the ETC transaction is conducted in accordance with the appropriate ETC communication protocol. The ETC-specific module or ASIC controls operation of the transponder to complete the transaction.

If the reader transmission is not ETC-related, then in step 110 the ETC-specific module or ASIC is instructed to exit the ETC mode and enter a pass-through mode, wherein any communications from the reader are passed through to the microcontroller configured to interface with the vehicle information system. Communications generated by the microcontroller for transmission to the reader are passed to the RF module for excitation of the antenna. In step 112, the vehicle information exchange is controlled and conducted by the microcontroller in communication with the reader and the data bus.

It will be appreciated, that the foregoing method 100 may by modified or adapted to a different hardware configuration within the transponder. For example, in some embodiments the transponder may operate in a default vehicle information mode and may be instructed to enter an ETC mode when an ETC communication is detected. In some embodiments, the RF module may not be incorporated within the ETC-portion of the transponder and may include a routing module for determining whether to send communications to an ETC module or a vehicle information module. Other modifications or variations will be understood by those skilled in the art.

Integrating an ETC transponder with a vehicle information system allows for greater exploitation of the existing roadside ETC infrastructure for a wider range of applications. It may further motivate wider deployment of ETC-capable infrastructure given the wider range of applications. Applications for remote on-road access to vehicle information include vehicle-specific emissions testing and certification, emissions data collection and analysis, anti-theft vehicle tracking, weigh station bypass, vehicle safety inspection and monitoring, road condition profiling, and any other application that may benefit from roadway access to on-board vehicle information.

In one embodiment, the reader may be a portable and/or handheld reader. A handheld reader and methods of reading transponders using such a reader are described in U.S. patent application Ser. No. 10/439,641 owned in common herewith, the contents of which are hereby incorporated by reference.

Figure 1:
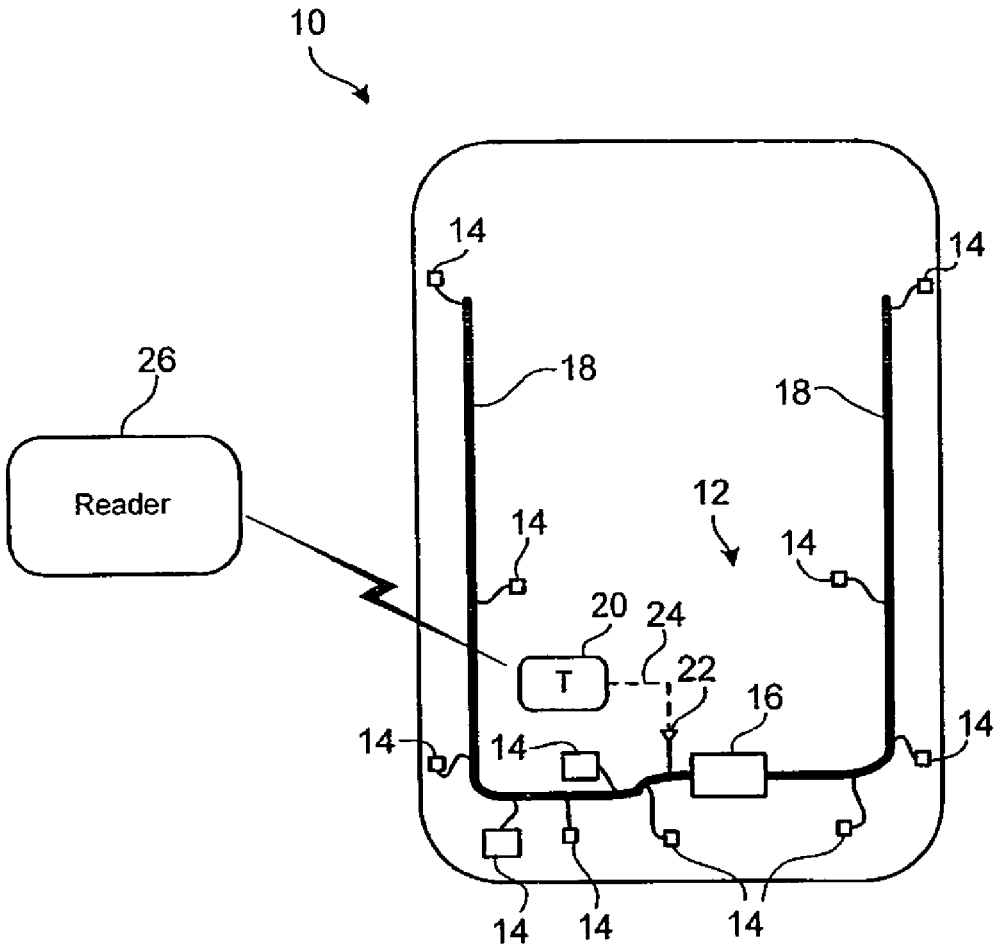
FIG. 1 diagrammatically shows a vehicle equipped with a vehicle information system.

Reference is now made to FIG. 1, which diagrammatically shows a vehicle 10 equipped with a vehicle information system 12. The vehicle information system 12 includes a plurality of devices 14 and a controller 16. The devices 14 may include sensors, servos, microcontrollers, indicators, and any other electrical or electromechanical devices that may be included in a vehicle.

The controller 16 and the devices 14 are interconnected by way of a data bus 18. In some embodiments, the data bus 18 comprises an OBD-compliant bus. In some embodiments, the data bus 18 comprises a J1708 and/or J1939 compliant bus (a "J-bus"). In other embodiments, the data bus 18 complies with another standard. The data bus 18 includes an access port 22.

The vehicle 10 is also equipped with the transponder 20. The transponder 20 comprises an active RF transponder. The transponder 20 includes an interface port for linking the transponder 20 with the data bus 18. The transponder 20 interface port is linked to the access port 22 by way of a short range link 24. The short range link 24 may comprise a wired link or a wireless link. The wireless link may include a Bluetooth™ wireless link. Through the short range link 24, the transponder 20 may obtain data from the data bus 18 and/or write data/commands/requests to the data bus 18.

The transponder 20 communicates with a roadside reader 26 external to the vehicle 10. The reader 26 and transponder 20 communicate by way of RF transmissions. In one embodiment, the RF transmissions between the transponder 20 and the reader 26 use a 915 MHz carrier. In another embodiment, a 5.9 GHz carrier is used. It will be appreciated that other carriers (and possibly subcarriers) may be used. The combination of the roadside reader 26, the transponder 20, and the vehicle information system 12, enables remote host systems or computers to query the vehicle information system 12 while the vehicle 10 is traveling on the road and passing by the reader 26. Information may be obtained remotely from the vehicle information system 12 and may be written to the vehicle information system 12 through the reader 26 and transponder 20. It will be appreciated, that the vehicle 10 need not be in motion for communications to occur between the transponder 20 and the reader 26; the vehicle 10 may be stationary in the reader's 26 coverage area.

Figure 2:
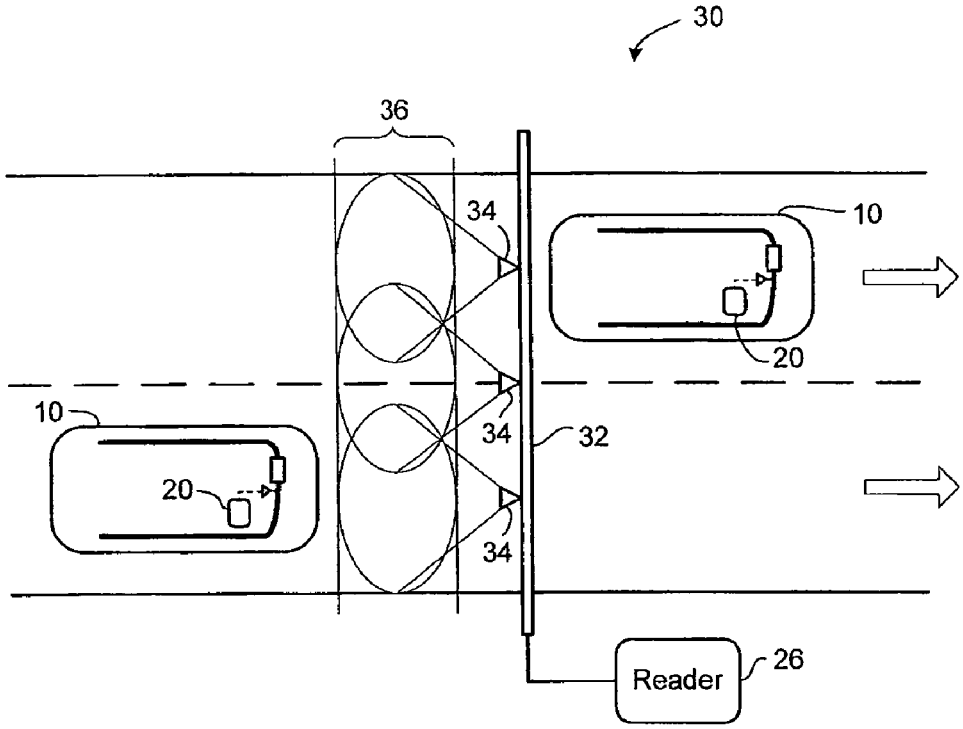
FIG. 2 shows a plan diagram of an electronic toll collection (ETC) system.

Reference is now made to FIG. 2, which shows a plan diagram of an electronic toll collection (ETC) system 30. The ETC system 30 includes the transponder 20 and reader 26. The transponder 20 is mounted on the vehicle 10 such that its antenna is disposed appropriately to communicate with roadside readers in the ETC system 30. For example, in some embodiments, the transponder 20 may be mounted on the windshield. In some embodiments, the transponder 20 may be mounted on the bumper proximate the license plate area, or upon the roof of the vehicle. In other embodiments, it may be housed within the vehicle body, with an antenna extending out of the vehicle body. The antenna may, in one embodiment, be incorporated into the windshield of the vehicle. Other possible locations for the transponder 20 will be understood by those of ordinary skill in the art.

The ETC system 30 may include a gantry 32 or other structure proximate a roadway. Mounted on the gantry 32 is a plurality of antennae 34. The antennae 34 are connected to and controlled by the reader 26. Each antenna 34 has an effective coverage zone. The collective coverage zones of the antennae 34 define a communication zone 36, within which the reader 26 may communicate with the transponder 20.

The ETC system 30 operates such that as the vehicle 10 enters the communication zone 36 (in either an open-road system or a gated system), the reader 26 establishes contact with the transponder 20. For example, the reader 26 may broadcast an interrogation signal. Upon sensing the interrogation signal the transponder 20 may radiate a response signal. The response signal may include a transponder ID code and other information to enable the reader 26 to track the transponder 20 through the communication zone 36. Upon detecting the presence of a transponder 20 in the communication zone 36, the reader 26 then implements a toll transaction protocol. In some embodiments, the reader 26 may calculate a toll amount, may determine whether the transponder 20 has an associated account stored on a remote database and having sufficient credit to pay the toll amount, may debit the account at the remote database, and may send a signal to the transponder 20 confirming the toll amount and the fact that it has been paid. Other protocols for conducting ETC transactions may be employed by the ETC system 30. Example ETC systems are described in U.S. Pat. Nos. 6,661,352 and 6,191,705, owned in common with the present application, the contents of which are hereby incorporated by reference.

In accordance with an aspect of the present application, the transponder 20 operates in both an ETC mode and a vehicle information mode. In the ETC mode, the transponder 20 conducts ETC transactions with the reader 26 in accordance with the pre-established communication protocol for such transactions. In the vehicle information mode, the transponder 20 enables the reader 26 to obtain information from the data bus 18 and to transmit data, instructions, or requests, to the data bus 18.

The reader 26 may instruct the transponder 20 to enter one of the two modes based upon an instruction signal. The transponder 20 may determine the mode in which to operate based upon the structure, format or content of a transmission from the reader 26. For example, an ETC instruction or request may have a format or code that distinguishes it from a vehicle information instruction or request. In some embodiments the two modes may be complimentary. For example, a vehicle information mode, which may be used for emissions inspection or diagnostic analysis, may have an associated fee or charge for the inspection or diagnosis. Following the vehicle information procedure, the ETC mode may be employed to pay for the vehicle inspection procedure.

VIS Buffering

Existing vehicle information systems, like OBD-II or J-bus, operate over a data bus for interconnecting various sensors, servos, and other electrical or electromechanical devices with a controller. The data buses are used for a variety of purposes. The protocols for these systems may establish a hierarchy of priorities. Higher priority data or devices may enjoy greater access to the bus than lower priority data or devices. For example, emissions control data is considered lower priority data. As a result, when a vehicle owner attends a service station to have an emissions test performed, there can be a significant delay before the service station is able to access emissions data from the data bus.

Figure 5:
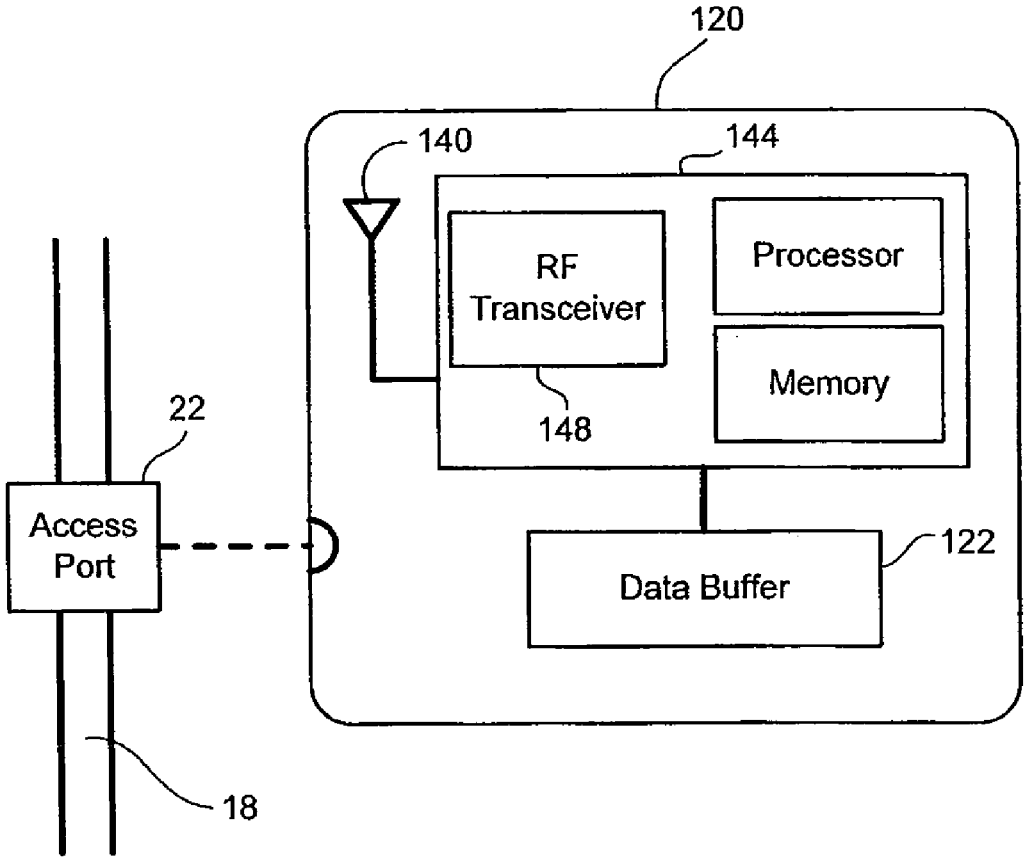
FIG. 5 shows a block diagram of an embodiment of a transponder.

Reference is made to FIG. 5, which shows a block diagram of an embodiment of a transponder 120. The transponder 120 is connected to the access port 22 of the vehicle information data bus 18. The transponder includes an antenna 140 and a microcontroller 144. In this embodiment, the microcontroller 144 implements an RF transceiver module 148.

To speed up emissions testing and to facilitate open road emissions testing, the transponder 120 includes a data buffer 122. The data buffer 122 is configured to capture/mirror data appearing on the bus 18 relating to one or more selected codes. For example, the data buffer 122 may collect information regarding emissions as it appears on the bus 18. Updated information may overwrite previously collected information; or the information may be collected in addition to previous information to provide a historical picture, depending on the application desired.

In another embodiment, the microcontroller 144 actively polls or queries one or more devices on the data bus 18 on a random or periodic basis in order to collect information for storage in the data buffer 122.

In one embodiment, the storage of data in the data buffer 122 is not continuous or ongoing, but is triggered on request. For example, a communication from a roadside reader 26 (FIG. 1) may instruct the transponder 120 to begin accumulating data. Alternatively, the transponder 120 may include a button, switch, or other user input device that, when activated, instructs the transponder 120 to being accumulating data in the data buffer 122. When next queried for emissions information, the transponder 120 reads the information from the data buffer 122 and sends it to the reader 26.

Figure 6:
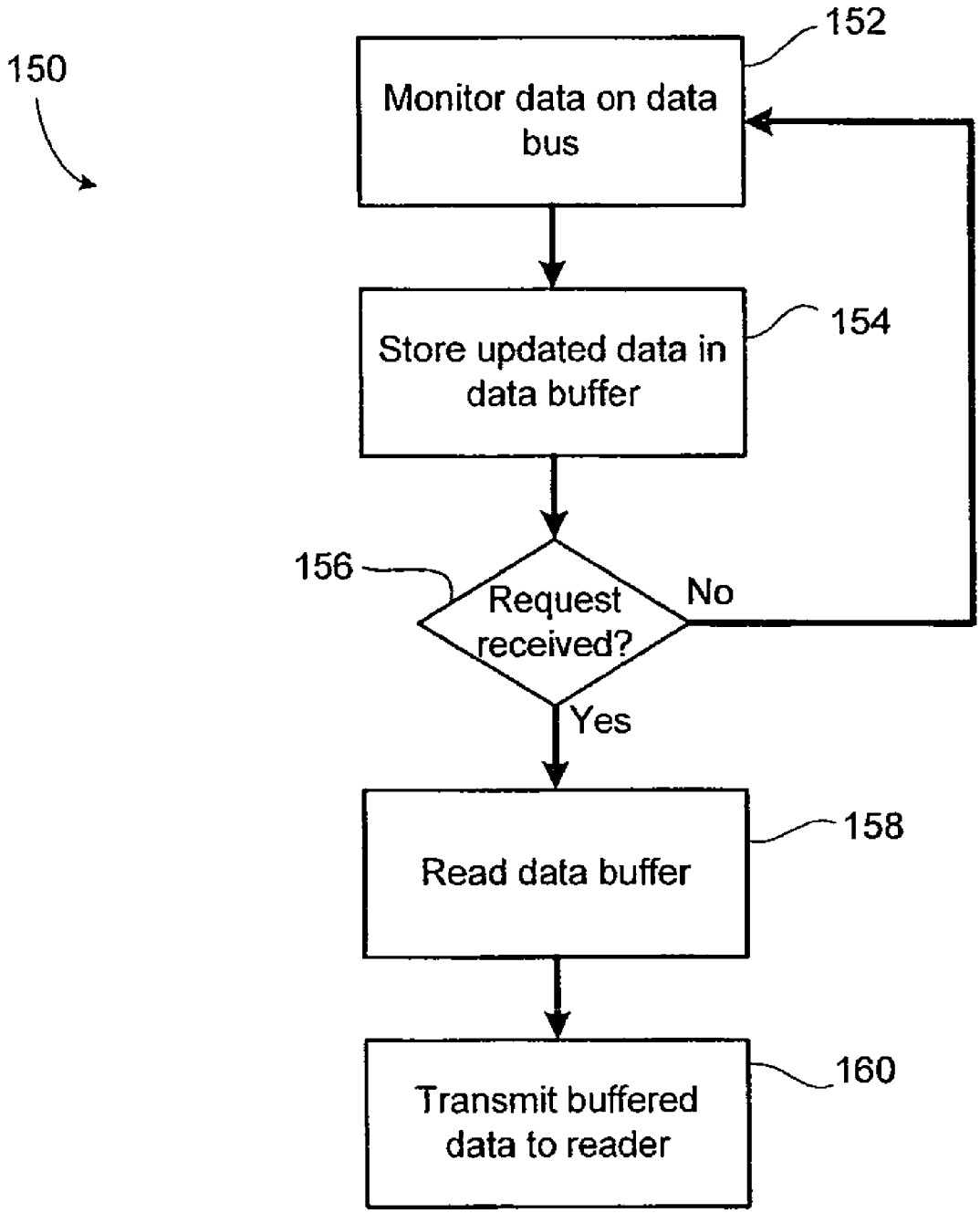
FIG. 6 shows, in flowchart form, a method of buffering emissions control data.

Reference is now made to FIG. 6, which shows, in flowchart form, a method 150 of buffering emissions control data. The method 150 starts in step 152 with the collection of data from the data bus. As discussed above, the data may be provided by a device to the transponder in response to a request from the transponder. Alternatively, the transponder monitors the data bus for the presence of relevant data without specifically requesting it. In any event, the transponder stores the newly found data in the data buffer in step 154. This may include adding the data to previously collected data or updating previously collected data by overwriting the old data with up-to-date data.

In step 156, the transponder evaluates whether it has received a request for emissions data from a reader 26. If not, then it cycles back to step 152 to continue accumulating data. If so, then in step 158 it reads the data buffer and in step 160 it transmits the data in the data buffer to the reader.

It will be appreciated that the data buffer 122 may be used to store data from the data bus 18 relating to other measures besides emissions control.

On-road Emissions Testing

Figure 7:
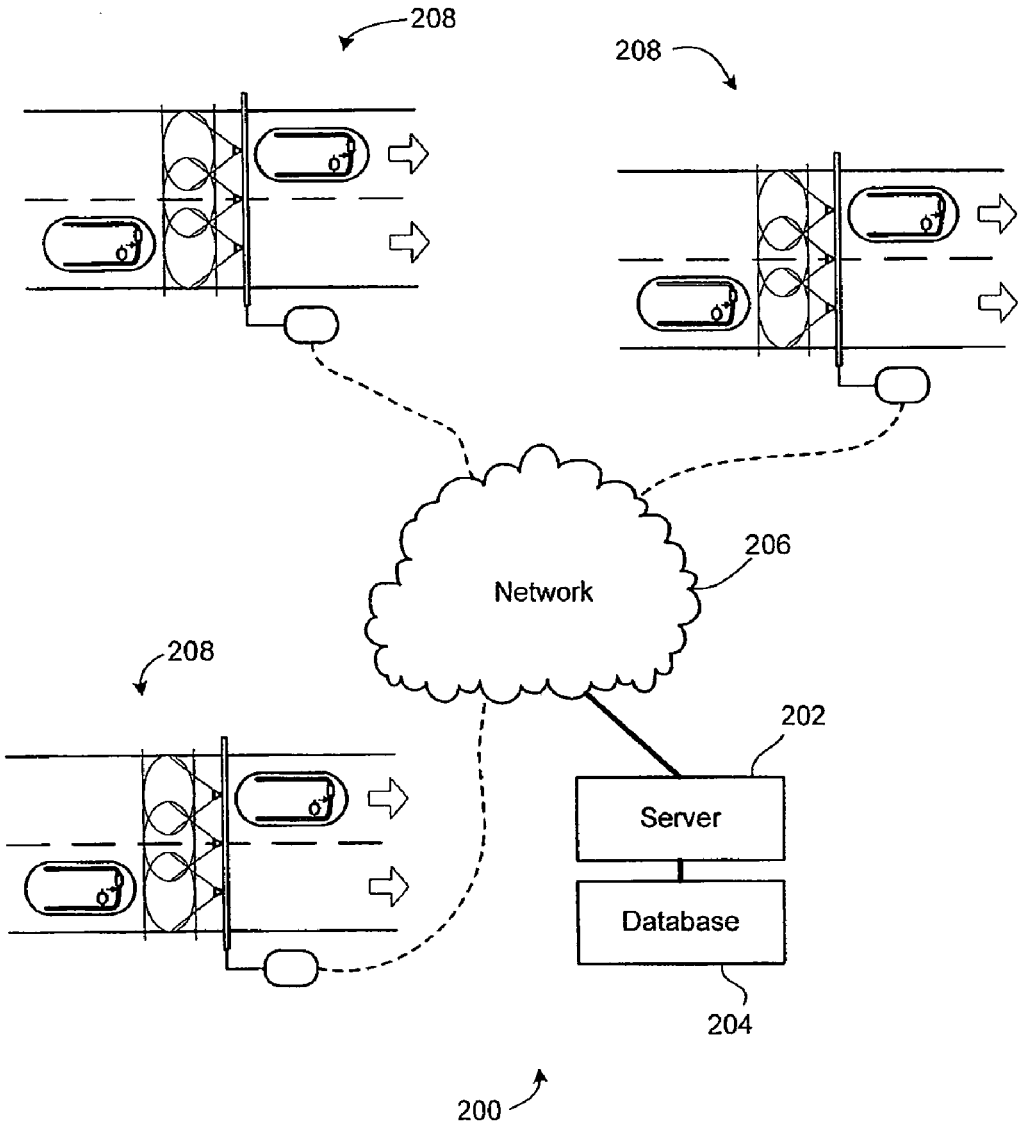
FIG. 7 diagrammatically shows a remote emissions control system.

Reference is now made to FIG. 7, which diagrammatically shows a remote emissions control system 200. The remote emissions control system 200 includes a central server 202 and database 204, wherein the central server 202 runs an emissions control monitoring and enforcement program. The database 204 stores information regarding individual vehicles and the emissions test(s) associated with such vehicles.

The central server 202 is connected to a plurality of roadside emissions test systems 208 through a wide area network 206. The network 206 may include private and/or public networks or a combination thereof. The emissions test systems 208 include roadside readers 26 (FIG. 1) and associated equipment for communicating with vehicles in a roadway. In one embodiment, the emissions test systems 208 are open-road systems.

The emissions test systems 208 obtain emissions information from the vehicle information systems of individual vehicles on the associated roadway and send it to the central server 202. The emissions test systems 208 obtain vehicle identification information along with emissions information so that the emissions information can be associated with a particular vehicle. The vehicle identification information may include, for example, a vehicle identification number (VIN), a license plate number, and/or a vehicle owner name.

The remote emissions control system 200 may be used to verify the data stored in the database 204. The verification may allow for the validation of emissions control status and/or the detection of tampering or fraud. For example, if a vehicle in a roadway is detected to have an emissions fault, i.e. the vehicle MIL light is illuminated, and the database 204 indicates that the vehicle may have recently passed an emissions test, then it may be indicative of tampering with the vehicle in order to temporarily provide sufficient positive data to pass the emissions test.

The remote emissions control system 200 may also be used to certify tested vehicles as compliant. If a vehicle passes through an emissions test system 208 and provides vehicle information indicative of a pass condition, then the vehicle owner may be notified that the vehicle is emissions compliant. Notification could be send by mail, e-mail, or otherwise. The owner would therefore not need to take the vehicle to a test centre when renewing his or her vehicle registration.

Existing ETC systems have mechanisms for associating ETC information with individual vehicles. These mechanisms may be advantageously employed to associate emissions information with a particular vehicle in the roadway for enforcement or validation purposes. For example, U.S. Pat. No. 6,219,613 owned in common herewith describes a mechanism for determining the position of a vehicle in an ETC system.

The remote emissions control system 200 may be used for statistical data gathering and/or testing. For example, the remote emissions control system 200 may collect emissions data for a roadway. This data may be compared with data collected from other geographic locations. Data may be associated with particular makes or models of vehicle.

In one embodiment, if the remote emissions control system 200 detects an emissions control problem with a vehicle, then it triggers issuance of a notice to the vehicle owner that the emissions control problem must be investigated and repaired. In some embodiments, if the problem is detected again after a preset period (say, one or two months) from the notice, then fines or other enforcement mechanisms may be applied.

Figure 8:
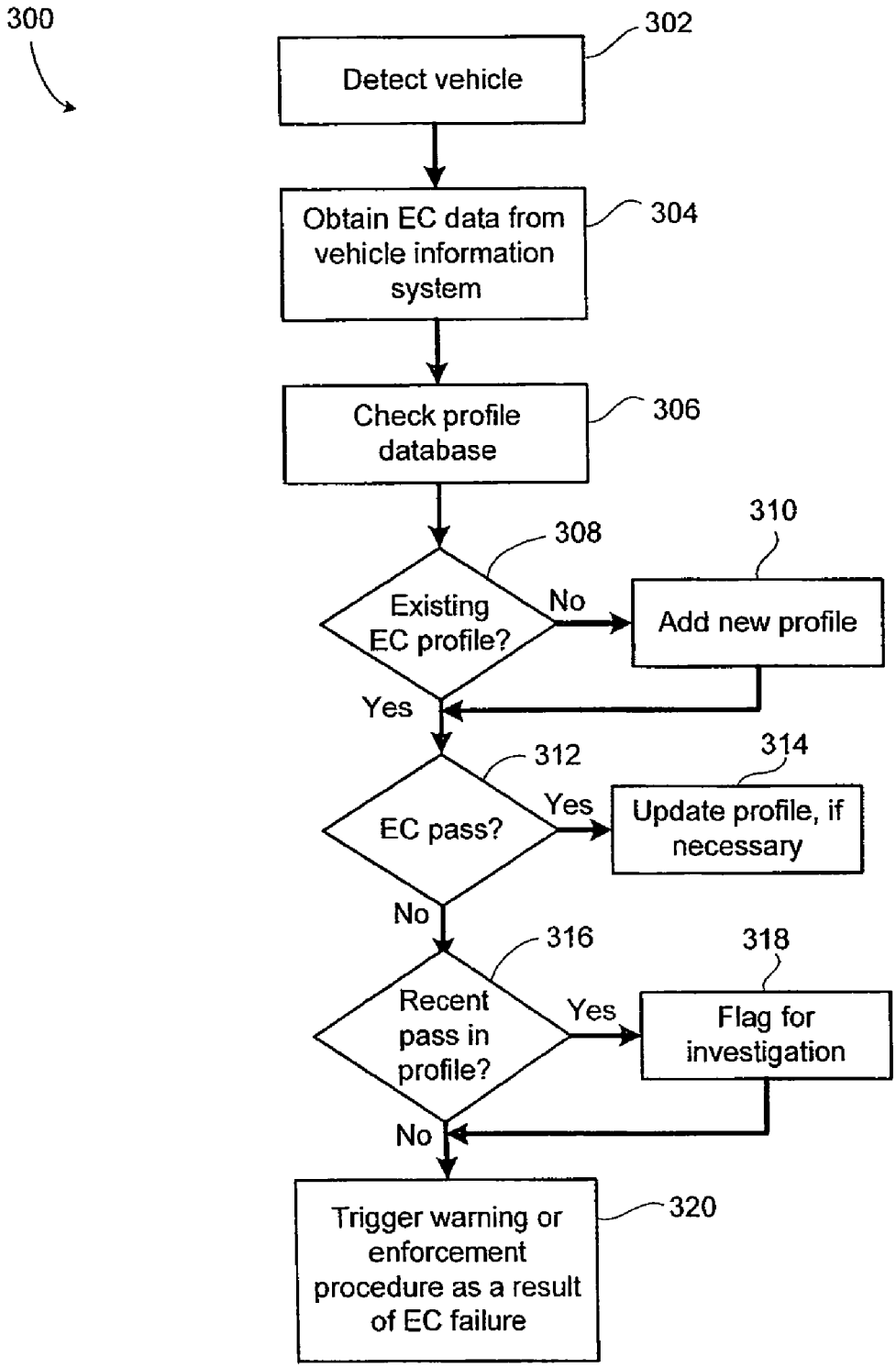
FIG. 8 shows, in flowchart form, a method for remote monitoring of emissions status of vehicles.

Reference is made to FIG. 8, which shows, in flowchart form, a method 300 for remote monitoring of emissions status of vehicles. The method 300 begins in step 302 with detection of the vehicle in a communications zone of an emissions control system 208 (FIG. 7). In step 304, emissions control data is obtained from the vehicle information system through RF communications with an on-board transponder that relays information from the vehicle information system to a roadside reader. The emissions control data includes a vehicle identifier, such as a VIN number. The emissions control data is sent by the emissions control system 208 to the central server 202 (FIG. 7).

In step 306, the central server 202 queries the database 204 (FIG. 7) to determine if an emissions control profile exists for the vehicle identified by the emissions control system 208. In step 308, the central server 202 determines whether there is an existing emissions control profile for the vehicle. If not, then the collected emissions control data may be used to generate a new profile for the vehicle, which is stored in the database in step 310.

In step 312, the central server 202 evaluates whether the emissions control data indicates that the vehicle has passed. If so, then in step 314 it may update the vehicle profile stored in the database. If not, then the method 300 continues to step 316, wherein the central server 202 may determine whether the profile stored in the database indicates a recent pass of an emissions test. If so, then the server 202 may flag the vehicle as a potential tampering or fraud situation requiring further analysis or investigation.

In step 320, as a result of the emissions failure detected in the emissions control data, the central server 202 may trigger a notification and/or enforcement process. For example, the vehicle owner may be sent a notice regarding the failed test and the requirement to repair the vehicle. Repeated failures may result in imposition of a fine or other enforcement measures.

Encryption and Security

It will be appreciated that the remote and transparent open road collection of vehicle information, including a VIN number, may raise privacy concerns. Accordingly, the transponder may implement an encryption scheme to encrypt any data broadcast to a roadside reader. Moreover, before sending any data to a roadside reader, the transponder may require authentication of the reader identity. Various encryption and/or authentication schemes may be implemented. Those schemes compatible with the RF communication protocols, bandwidth limitations, processing capabilities, and time limitations of a particular implementation will be understood by those of ordinary skill in the art.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A transponder for engaging in RF communications with a roadside reader from a vehicle, comprising:

an antenna;

an electronic toll collection (ETC) component, the ETC component including an RF transceiver coupled to said antenna for modulating outgoing signals and for demodulating received signals, and a controller for implementing a pre-defined ETC communications protocol to detect and interpret said received signals and generate response signals for transmission as said outgoing signals when operating in an ETC mode, and wherein the ETC component includes a bypass port; and an external interface coupled to said bypass port and having an external port for receiving input signals, wherein said controller includes a bypass module for receiving a bypass instruction and entering a bypass mode, wherein in said bypass mode said input signals are relayed from said external interface to said RF transceiver for transmission as said outgoing signals.

2. The transponder claimed in claim 1, wherein said ETC component comprises an application-specific integrated circuit or a gate array.

3. The transponder claimed in claim 1, wherein the received signals from the roadside reader contain the bypass instruction, and wherein said controller includes a component for detecting the bypass instruction in the demodulated received signals.

4. The transponder claimed in claim 1, further including a microcontroller connected to said bypass port for implementing a non-ETC application, said microcontroller having an input/output port connected to said external interface, and wherein said microcontroller receives the demodulated received signals from said bypass port.

5. The transponder claimed in claim 4, wherein said microcontroller includes a detection module for detecting whether the received signals relate to an ETC transaction or said non-ETC application, and if related to said non-ETC application, generating said bypass instruction and sending said bypass instruction to said controller.

6. The transponder claimed in claim 5, wherein said external interface is adapted to be connected to a vehicle information system, and wherein said non-ETC application includes reading and writing to said vehicle information system from the roadside reader.

7. The transponder claimed in claim 6, further including a memory buffer for temporarily storing data read from the vehicle information system.

8. The transponder claimed in claim 7, wherein the data read from the vehicle information system comprises emissions data, and wherein said non-ETC application comprises an emissions certification program.

9. The transponder claimed in claim 1, wherein said external interface is configured to connect to a peripheral device to enable the peripheral device to communicate with the roadside reader for a non-ETC application.

10. The transponder claimed in claim 9, wherein the peripheral device includes a biometric identification device, and wherein the non-ETC application includes providing biometric user identity data to the roadside reader.

11. The transponder claimed in claim 10, wherein the biometric identification device comprises a fingerprint scanner.

12. The transponder claimed in claim 1, wherein said external interface is configured to connect to a vehicle information system, and said outgoing signals include vehicle data from said vehicle information system.

13. The transponder claimed in claim 12, wherein said vehicle data includes emissions data.

14. A transponder for engaging in RF communications with a roadside reader from a vehicle, comprising:

means for propagating an outgoing signal and receiving an incoming signal;

means for modulating an information signal to generate the outgoing signal and demodulating the incoming signal to generate a received signal;

means for controlling the means for modulating to implement a pre-defined ETC communications protocol by receiving the received signal and generating the information signal when operating in an ETC mode; and means for interfacing with an external device to receive external signals and input the external signal to the means for controlling, wherein said means for controlling includes means for bypassing the pre-defined ETC communications protocol by receiving a bypass instruction and entering a bypass mode, wherein in said bypass mode said external signals are relayed from said means for interfacing to said means for modulating for transmission as said outgoing signal.

15. The transponder claimed in claim 14, wherein the received signal from the roadside reader contains the bypass instruction, and wherein said means for controlling detects the bypass instruction in the demodulated received signals.

16. The transponder claimed in claim 14, further including a control means for implementing a non-ETC application connected to the means for controlling and connected to the means for interfacing, and wherein said control means receives the received signal via the means for controlling.

17. The transponder claimed in claim 16, wherein said control means includes means for detecting whether the received signals relate to an ETC transaction or said non-ETC application, and if related to said non-ETC application, generating said bypass instruction and sending said bypass instruction to said means for controlling.

18. The transponder claimed in claim 17, wherein said means for interfacing is configured to be coupled to a vehicle information system, and wherein said non-ETC application includes reading and writing to said vehicle information system from the roadside reader.

19. The transponder claimed in claim 18, further including buffer means for storing selecting data from the vehicle information system in response to a buffer instruction from the roadside reader.

20. The transponder claimed in claim 14, wherein said means for interfacing is configured to connect to a peripheral device to enable the peripheral device to communicate with the roadside reader for a non-ETC application.

21. The transponder claimed in claim 20, wherein the peripheral device includes a biometric identification device, and wherein the non-ETC application includes providing biometric user identity data to the roadside reader.

22. The transponder claimed in claim 14, wherein said means for interfacing is configured to connect to a vehicle information system, and said outgoing signals include vehicle data from said vehicle information system.

23. The transponder claimed in claim 22, wherein said vehicle data includes emissions data.

24. A method for engaging in RF communications between a dual purpose vehicle-mounted transponder and a roadside reader, the transponder having an ETC controller for implementing a predefined ETC communications protocol, the method comprising the steps of:

receiving an incoming signal from the roadside reader;

demodulating the incoming signal to generate a received signal;

determining whether the received signal relates to an ETC transaction or a non-ETC application;

generating a response signal in accordance with a predefined ETC communications protocol by the ETC controller and transmitting the response signal to the roadside reader, if the received signal relates to said ETC transaction; and receiving input data from an external device and transmitting the input data to the roadside reader, if the received signal relates to said non-ETC application.

* * * * *